US005775953A

United States Patent [19]

Yamanashi et al.

[11] Patent Number: 5,775,953

[45] Date of Patent: Jul. 7, 1998

[54] LOW-INSERTION-FORCE CONNECTOR ASSEMBLY

[75] Inventors: Makoto Yamanashi; Masahiro Sawayanagi, both of Shizuoka, Japan

[73] Assignee: Yazaki Corporation, Tokyo, Japan

[21] Appl. No.: 645,756

[22] Filed: May 14, 1996

[30] Foreign Application Priority Data

May 16, 1995 [JP] Japan ..... 7-116682

[51] Int. Cl.[6] ..... H01R 13/502

[52] U.S. Cl. ..... 439/701; 439/357

[58] Field of Search ..... 439/299, 345, 439/350, 357, 374, 378, 701, 717

[56] References Cited

U.S. PATENT DOCUMENTS

| | | | |
|---|---|---|---|
| 5,190,476 | 3/1993 | Chaillot | 439/701 X |
| 5,454,733 | 10/1995 | Watanabe et al. | 439/701 X |
| 5,472,357 | 12/1995 | Yamanashi | 439/701 |

FOREIGN PATENT DOCUMENTS

| | | |
|---|---|---|
| 4-33666 | 8/1992 | Japan . |
| 5-234634 | 9/1993 | Japan . |
| 6-111882 | 4/1994 | Japan . |
| 6-215830 | 8/1994 | Japan . |

*Primary Examiner*—Khiem Nguyen

*Attorney, Agent, or Firm*—Armstrong, Westerman, Hattori, McLeland & Naughton

[57] ABSTRACT

In a connector assembly including a pair of first and second connector housings, first and second adjacent connector housing units constituting of the first connector housing are coupled so as to be slidable in a fitting direction. A resilient securing arm is formed on an opposite wall of the first connector housing unit, a provisional securing piece is formed on another opposite wall of the second connector housing unit, and a protrusion for releasing provisional securing is formed on a fitting plane of the second connector housing. The resilient securing arm is abutted on said provisional securing piece to secure the first connector housing unit to the second connector housing unit provisionally in a state where the former is ahead of the latter. After the first connector housing unit is mated with the second connector housing, the protrusion is hit on the provisional securing piece so that provisional securing of the first and second connector housing units is released; and thereafter, the second connector housing unit is mated with the second connector housing.

4 Claims, 8 Drawing Sheets

LOW-INSERTION-FORCE CONNECTOR ASSEMBLY

BACKGROUND OF THE INVENTION

1. Field of the Invention

The present invention relates to a connector assembly used in electrical wiring for vehicles, and more particularly to a connector assembly which can reduce insertion force in such a manner that the one of connector housings to be coupled with each other is divided into plural connector housing units and these connector housing units are fit into the other connector housing successively step by step.

2. Description of the Prior Art

In recent years, the electric wiring for a vehicle has been complicated increasingly. Because of this tendency, the connector housing used in a wiring harness of a vehicle requires a multipolar structure having a number of terminals to be accommodated. The multipolar structure necessarily requires insertion force for coupling connector housings with each other according to increased coupling force between the terminals.

Thus, the multipolar structure of the connector housing makes it difficult to couple the connector housings with each other in a connector mounting step, and may lead to poor contact of the connector housings due to incomplete insertion.

In order to reduce the insertion force for the multipolar connector housing, a connector assembly or device, generally K disclosed in JP-A-6-111882 and shown in FIG. 11 has been proposed has been proposed.

In the first connector housing a of the connector assembly or device K, an outer housing b includes a fixed terminal holder c and a movable terminal holder d, and the movable terminal holder d is secured ahead of the fixed terminal holder c.

When the one connector housing a is inserted into the second connector housing e, first, a group of terminals located on the movable terminal holder d are coupled with those of the second connector housing e. Subsequently, another group of terminals located on the fixed terminal holder c are coupled with those of the second connector housing e. In this way, groups of terminals are coupled separately in two steps so that the insertion force required for coupling the connector housings with each other can be reduced to about ½.

However, in the connector assembly K as shown, the movable terminal holder d does not have a locking mechanism for the second connector housing e and the outer housing b has a locking mechanism f on only the one side. For this reason, in fitting or mating operation, the outer housing b is apt to be inclined, thus leading incomplete fitting. In fitting operation, the securing arms g of the movable terminal holder d is warped by ribs h in the second connector housing e so that the movable terminal holder d is secured. Thus, during use, plastic deformation occurs to provide insufficient securing force, thus leading to poor fitting of the connector housings.

Another proposal of a low insertion force connector assembly, generally K' as shown in FIG. 12 is disclosed in JP-A-6-215830.

The outer housing i of the first connector housing, generally i has a split connector k provided slidably and a protruding flexible bumping arm m. The first connector housing i is coupled with the second connector housing step by step though the flexible bumping arm m. However, the protruding bumping arm m that is lengthy is likely to be broken during a fitting operation. This requires a careful mounting operation, and may lower the workability and deteriorate reliability.

In both connector assemblies K and K', the first connector housing has an outer housing (b or j) for housing a split connector (d or k), and within the outer housing, the split connector (d or k) is operated. Thus, the entire connector assembly is necessarily accompanied by an increase in the volume and weight.

SUMMARY OF THE INVENTION

An object of the present invention is to provide a low insertion force connector assembly which permits the one connector housing to be coupled with the other connector housing easily and surely using low insertion force and can be miniaturized to be suited to a multipolar connector housing.

In order to attain the above object, in accordance with the present invention, there is provided a low-insertion-force connector assembly comprising a first and second connector housings to be mated with each other, the first connector housing including a plurality of connector housing units which are to be mated with the second connector housing successively step by step, comprising: adjacent connector housing units of said plurality of connector housing units being coupled so as to be slidable in a fitting direction; a resilient securing arm formed on an opposite wall of the first connector housing unit of said adjacent connector housing units; a provisional securing piece formed on another opposite wall of the second connector housing unit of said adjacent connector housing units; a protrusion for releasing provisional securing formed in a fitting plane of the second connector housing; wherein said resilient securing arm is abutted on said provisional securing piece to secure the first connector housing unit to the second connector housing unit provisionally in a state where the former is ahead of the latter; after the first connector housing unit is mated with the second connector housing, said protrusion is hit on the said provisional securing piece so that provisional securing of the first and second connector housing unit, and thereafter the second connector housing unit is released is mated with the second connector housing.

In accordance with the present invention, one connector housing includes a plurality of connector housing units and adjacent connector housing units thereof are slidably coupled with each other. In addition, the first connector housing unit can be provisionally secured ahead of the second connector housing unit. This permits the connector housing units of the first connector housing to be coupled with the corresponding second connector housing successively step by step.

For this reason, the insertion force of the individual connector housing unit in the first connector housing is satisfactory for that for the second connector housing. Accordingly, even when the connector at issue is a multipolar connector having a large number of terminals, by using a plurality of connector housing units, the low insertion force corresponding to the insertion force for a single connector housing unit permits all the connector housing units in the first connector housing to be coupled with the second connector housing. As a result, the operation of mounting the connector housings can be easily carried out.

Further, since the connector housing units are slidably coupled with one another, the connector housing requires no particular outer housing for housing connector housing units. For this reason, the size of the entire connector housing can be miniaturized so as to suited for a multipolar connector. Further, since the connector housing unit can be solely coupled with the other connector housing, an application field of the connector can be extended.

The above and other objects and features of the present invention will be more apparent from the following description taken in conjunction with the accompanying drawings.

DESCRIPTION OF THE PREFERRED EMBODIMENTS

Figure 1:
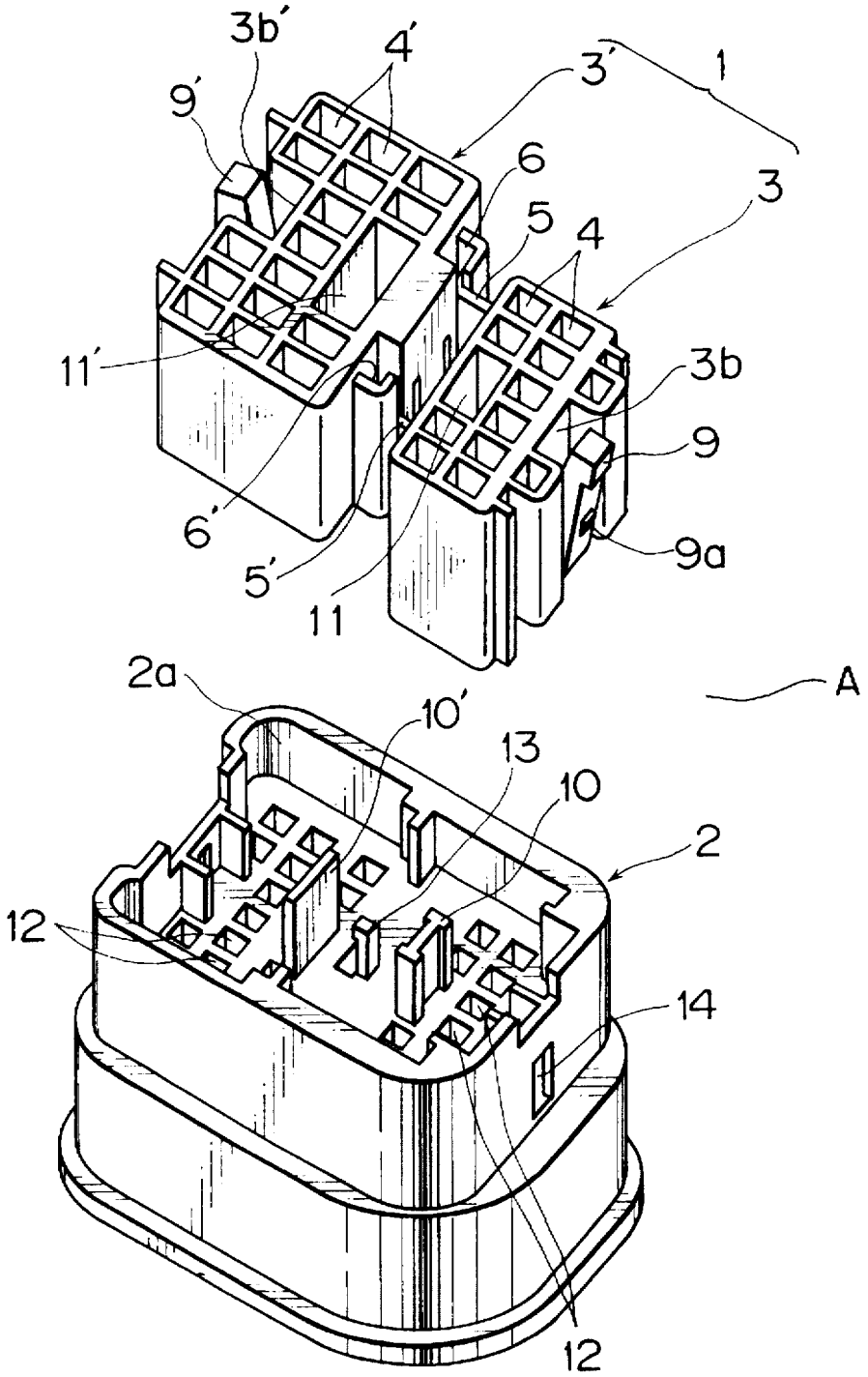
FIG. 1 is a perspective view of a low insertion force connector assembly consisting of the first and second connector housings according to one embodiment of the present invention.

FIG. 1 is a perspective view of a low-insertion-force connector assembly according to the present invention in an exploded state. The low-insertion-force connector assembly, generally A includes a pair of first and second connector housings 1 and 2 to be mated with each other. The first connector housing 1 includes a pair of first and second connector housing units 3 and 3' coupled with each other in a fitting direction.

Each of the connector housing units 3 and 3' is provided with plural terminal chambers 4 and 4', respectively. Within the terminal chambers 4 and 4', female terminals (not shown) are housed.

Figure 2A:
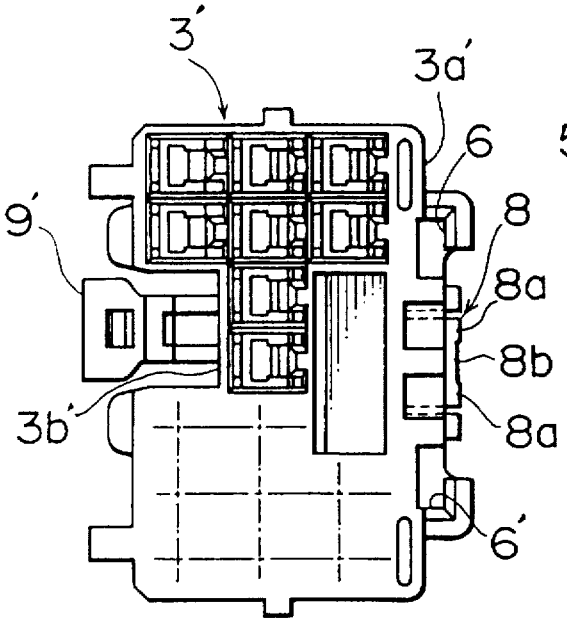
FIG. 2 is a background view of first and second connector housing units constituting the first connector housing in FIG. 1.
Figure 2B:
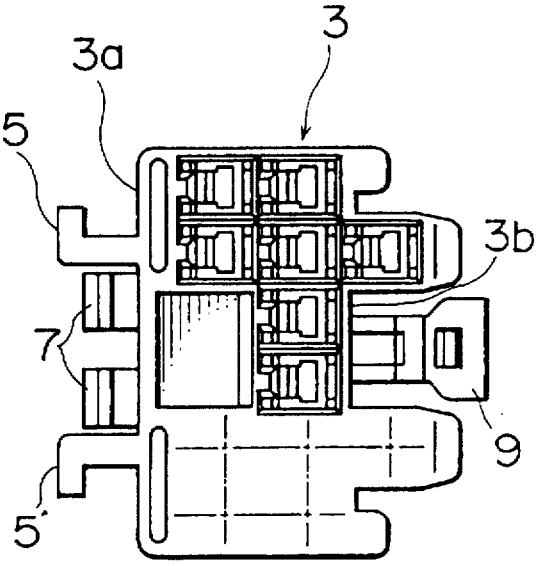
Figure 3A:
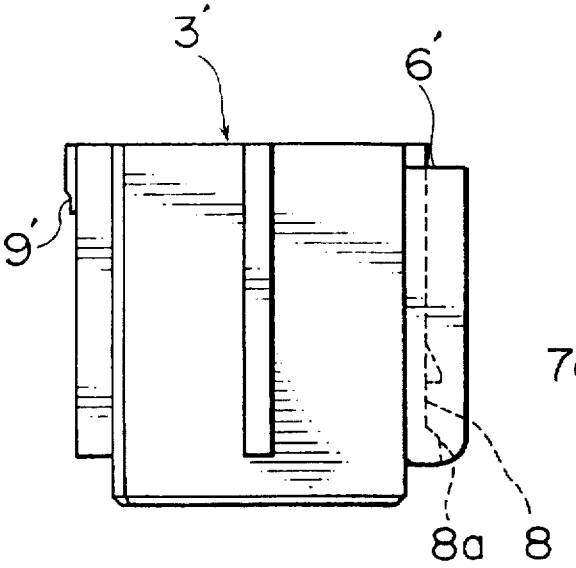
FIG. 3 is a side view of both connector housing units in FIG. 2.
Figure 3B:
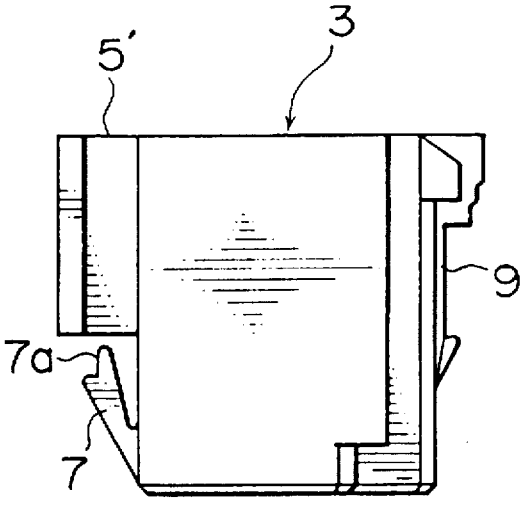

In the first connector housing unit 3, as shown in FIGS. 2 and 3, guide protrusions 5, 5' are formed on a guide wall 3*a*. These guide protrusions 5, 5' are fit into guide grooves 6, 6' provided on an opposite wall 3*a*' of the second connector housing unit 3' so that the connector housing units 3 and 3' are coupled with each other and slidable from each other in a fitting direction.

Between the guide protrusions 5 and 5', two resilient securing arms 7, 7 with free ends directed toward a direction opposite to the fitting direction, and the free ends thereof have securing steps 7*a*, 7*a*, respectively.

Between the guide grooves 6 and 6', a provisional securing piece 8 to be engaged with the resilient securing arms 7, with the free ends directed toward the fitting direction, is provided. The freed ends thereof have securing protrusions 8*a* corresponding to the securing steps 7*a* of the two resilient securing arms 7. Between the securing protrusions 8*a* and 8*a*, a sliding portion 8*b* is formed.

On the exterior walls 3*b* and 3*b*' of the respective connector housing units 3 and 3', resilient locking pieces 9 and 9' of the second connector housing are provided. For easy positioning of the first connector housing 1 for the other connector housing 2, fitting guide holes 11, 11', into which introducing protrusions 10 and 10' made in the second connector housing 2 are to be inserted, are provided in parallel to the terminal chambers 4 and 4'.

Figure 4:
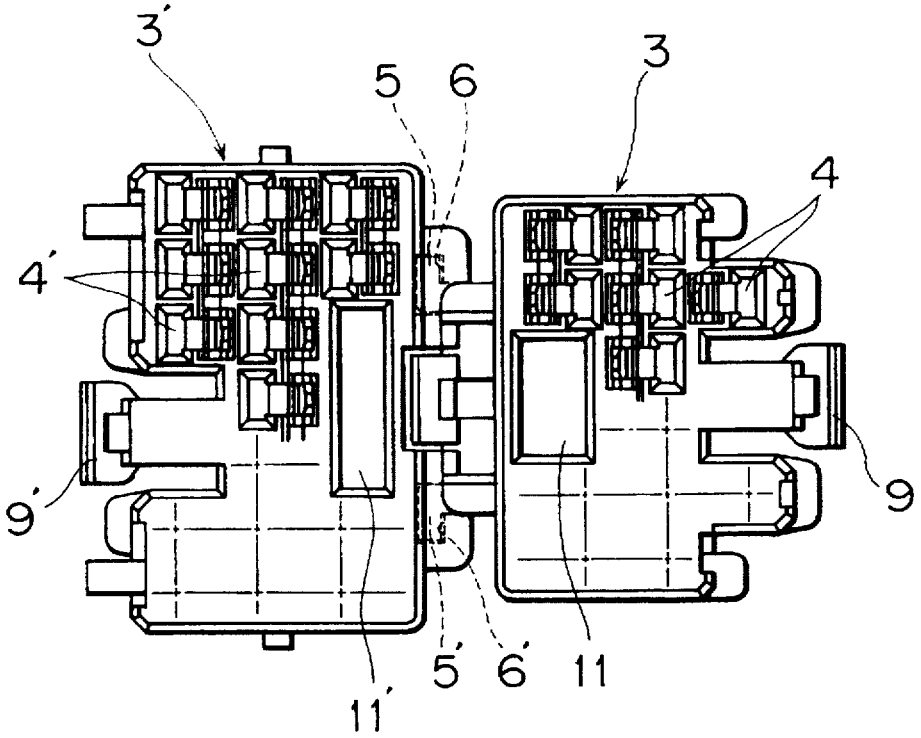
FIG. 4 is a front view of the state where both connector housing units in FIG. 2 are slidably coupled with each other.
Figure 5:
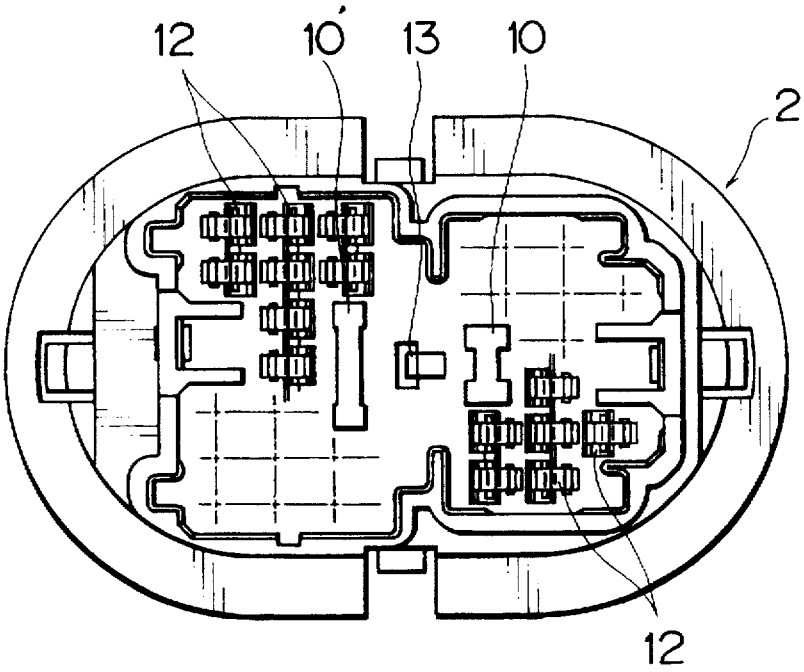
FIG. 5 is a front view of the second connector housing in FIG. 1.
Figure 6:
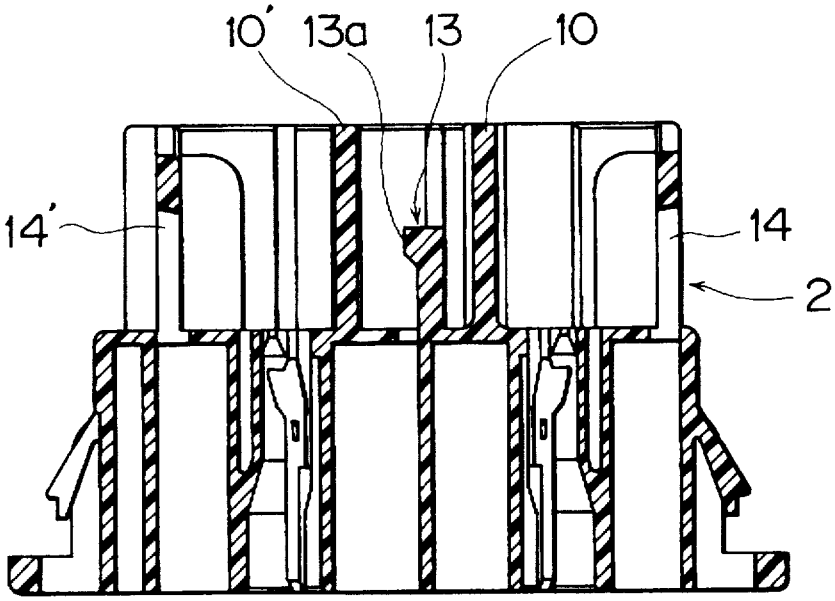
FIG. 6 is a longitudinal sectional view of the second connector housing in FIG. 5.

FIG. 4 shows the state where the first and second connector housing units 3 and 3' are coupled with each other as a result that the guiding protrusions 5, 5' of the one connector housing unit 3 are inserted into the guiding grooves of 6, 6' of the other connector housing unit 3'.

The second connector housing 2 has a circular receiver 2*a* for receiving the first connector housing 1, and a plurality of terminal chambers 12 are located within the receiver 2*a*. Within the respective terminal chambers 12, male terminals (not shown) to be coupled with the female terminals in the first connector housing 1 are to be housed. In the fitting plane of the second connector housing 2, the introducing protrusions 10 and 10' are formed and another protrusion 13 is formed therebetween.

On both sides of the receiver 2*a*, lock securing holes 14 and 14' are formed. The engagement pieces 9*a*, 9*a*' of the resilient lock pieces 9, 9' are to be engaged into the lock securing holes 14, 14' so that the first connector housing 1 (including the connector housing units 3 and 3') is fixed to the second connector housing 2.

An explanation will be given of teh process for inserting the first connector housing 1 into the second connector housing 2.

First, the guiding protrusions 5, 5' of the first connector housing unit 3 are inserted into the guiding grooves 6, 6' of the second connector housing unit 3' so that the securing steps 7*a* of the resilient securing arms 7 of the second connector housing unit 3 abut on the securing protrusions 8*a* of the provisional securing piece 8. Thus, the first connector housing unit 3 and the second connector housing unit 3' are coupled and provisionally secured to each other. In this state, the former is ahead of the latter.

Figure 7:
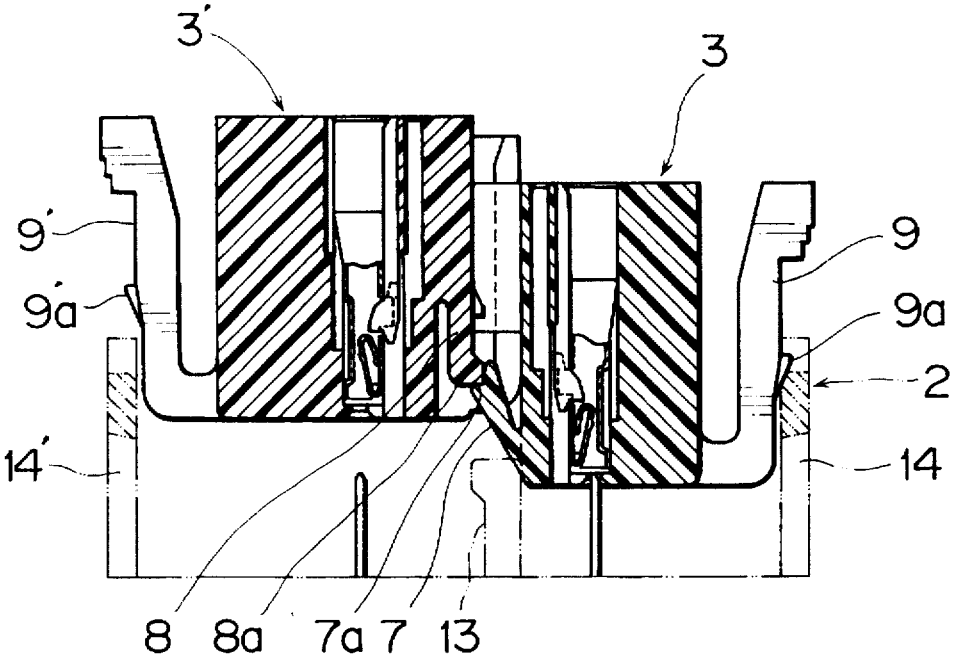
FIG. 7 is a view for explaining the process for inserting both connector housing units in the second housing in FIG. 1.
Figure 8:
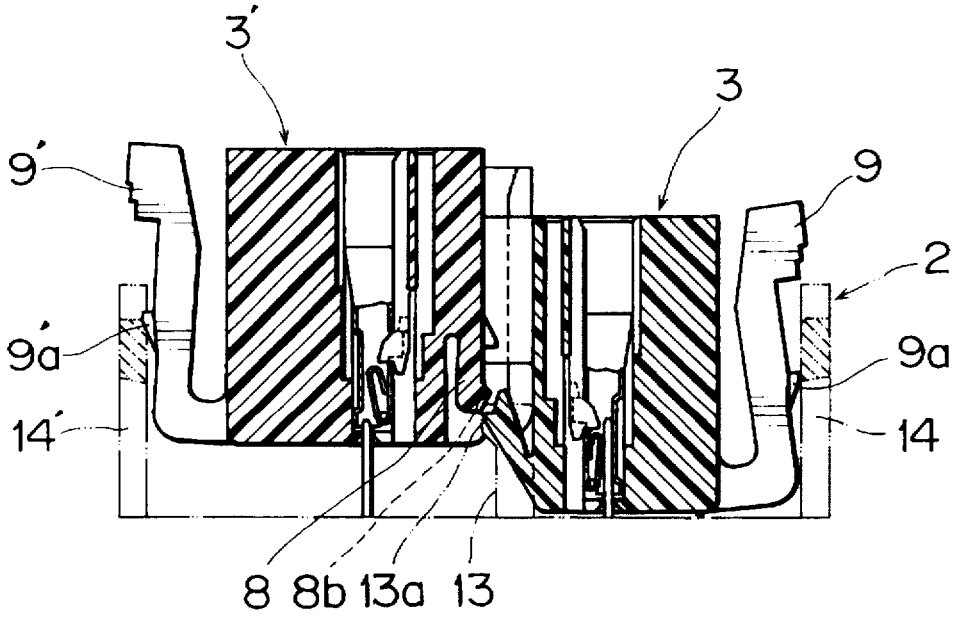
FIG. 8 is a view showing the state where the first connector housing unit in FIG. 7 is coupled with the second connector housing.

As shown in FIG. 7, the connector housing units 3, 3' are provisionally secured and fit into the receiver 2*a* of the second connector housing 2 so that the introducing protrusions 10 and 10' are inserted into the fitting guiding holes 11, 11'. Thus, as shown in FIG. 8, the first connector housing unit 3 is mated with the second connector housing 2 so that the male terminals in the second connector housing 2 are coupled with the female terminals in the connector housing unit 3. Then, the engagement piece 9*a* of the resilient locking piece 9 of the first connector housing unit 3 is engaged with the lock securing hole 14 so that the connector housing unit 3 is locked to the second connector housing 2. Further, the end 13*a* of the protrusion 13 hits on the sliding portion 8*b* of the provisional securing piece 8. Then, the provisional securing piece 8 is warped so that release of the provisional securing of the securing steps 7*a* of the resilient securing arms 7 and the securing protrusions 8*a* of the provisional securing piece 8 is started.

Figure 9:
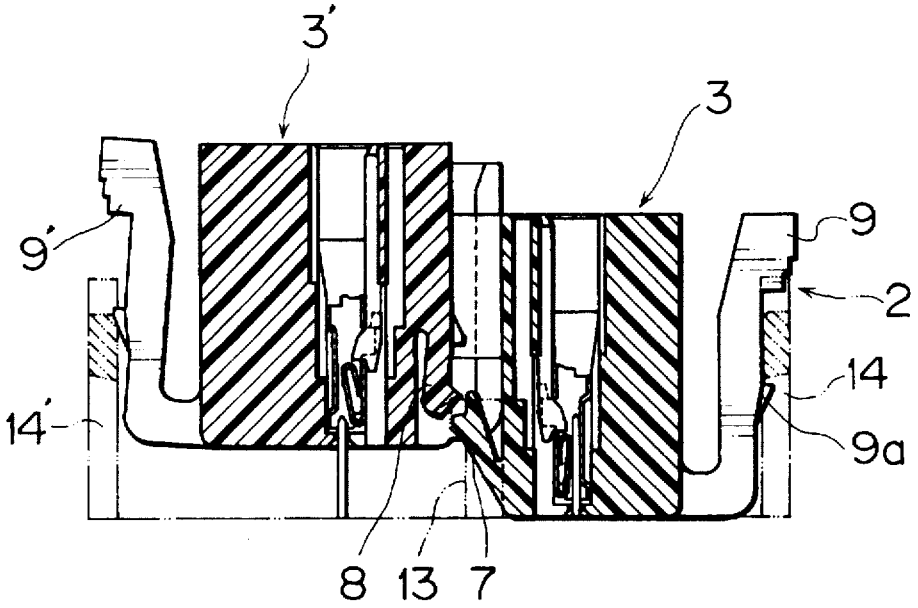
FIG. 9 is a view showing the state where release of the provisional securing between the first and second connector housing units in FIG. 8.
Figure 10:
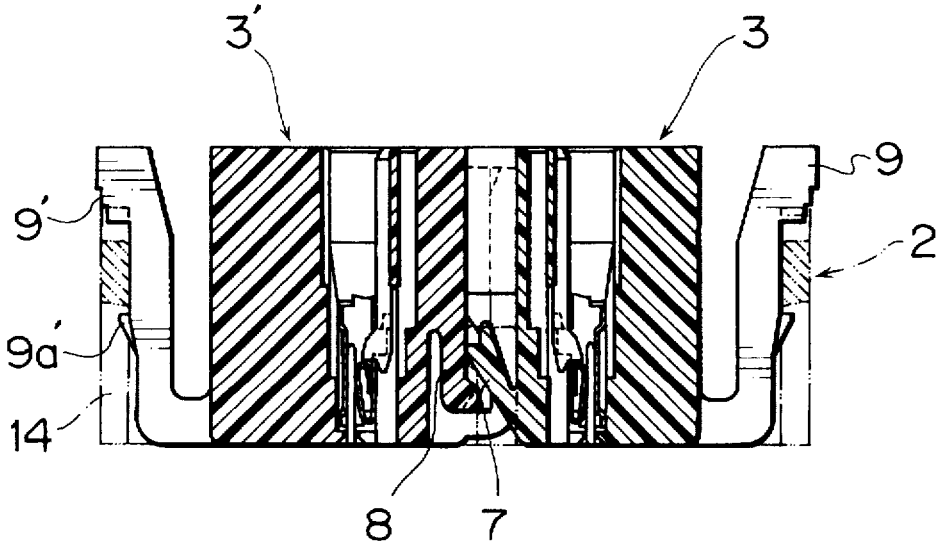
FIG. 10 is a view for explaining the state where the second connector housing unit in FIG. 9 is coupled with the second connector housing.
Figure 11:
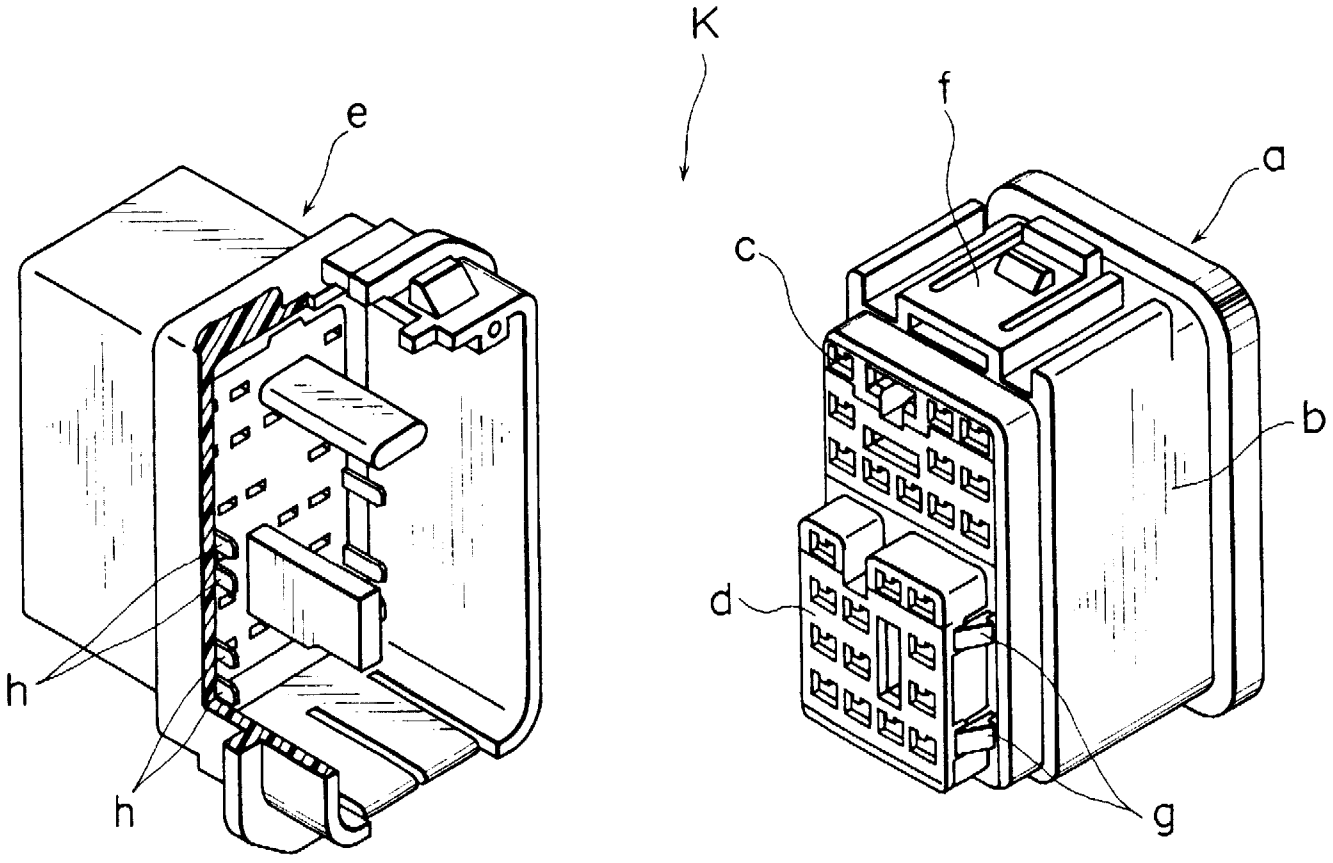
FIG. 11 PRIOR ART
FIG. 11 is a perspective view of a conventional low insertion force connector assembly having a movable terminal holder.
Figure 12A:
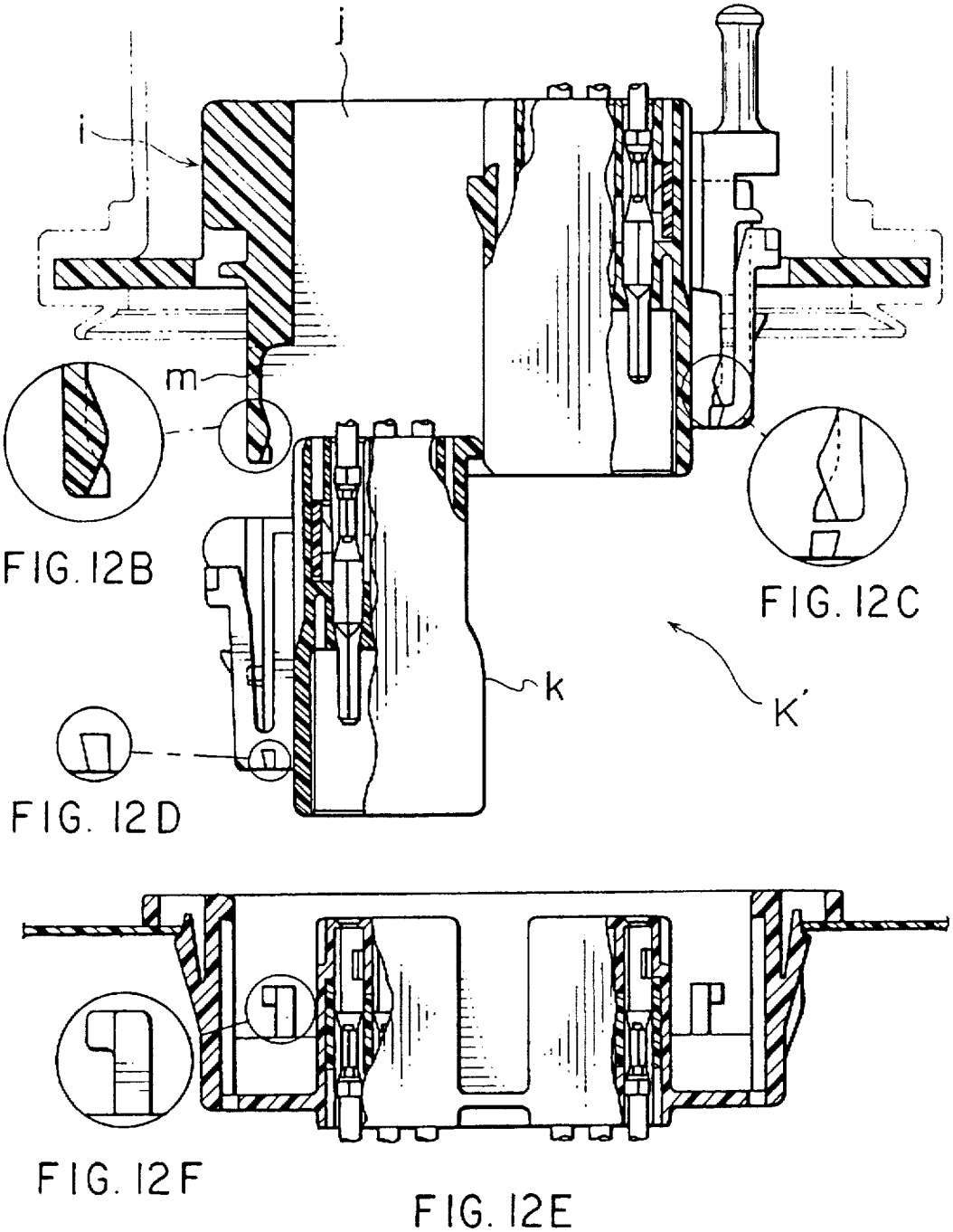
PRIOR ART FIG. 12A
FIG. 12 is a sectional view of another conventional low insertion force connector assembly.

The second connector housing unit 3' is pressed so that it further moves into the receiver 2*a* of the second connector housing 2. Then, as shown in FIG. 9, the protrusion 13 warps the provisional securing piece 8 so that the provisional securing of the resilient securing arms 7 and the provisional securing piece 8 is released. Thus, the connector housing unit 3' becomes movable into the receiver 2*a* of the connector 2. As shown in FIG. 10, the connector housing 2 and the connector housing unit 3' are mated with each other so that the male terminals in the second connector housing 2 are coupled with the female terminals in the second connector housing unit 3'. Then, the engagement piece 9*a'* of the resilient locking piece 9' of the second connector housing unit 3' is engaged with the lock securing hole 14' so that the second connector housing unit 3' is locked to the second connector housing 2.

In this embodiment, although the first connector housing 1 includes two connector housing units 3 and 3', the number of connector housing units should not be limited to 2. As necessity requires, three or more connector housing units can be used. In this case, on the opposite wall of the one of adjacent connector housing units, the resilient securing arms and the guiding protrusions are formed whereas on the opposite wall of the other thereof, the provisional securing piece and the guiding grooves are formed. Thus, all the connector housing units in the first connector housing can be coupled to the second connector housing. Accordingly, even for a multi-polar connector housing, a plurality of connector housing units in the first connector housing are coupled with the second connector housing successively step by step with low insertion force corresponding to the insertion force for a single connector housing unit.

What is claimed is:

1. A low-insertion-force connector assembly comprising:

first and second connector housings to be mated with each other, the first connector housing including a plurality of connector housing units which are to be mated with the second connector housing successively step by step;

adjacent connector housing units of said plurality of connector housing units being coupled so as to be slidable in a fitting direction;

a resilient securing arm formed on an opposite wall of a first connector housing unit of said adjacent connector housing units;

a provisional securing piece formed on another opposite wall of a second connector housing unit of said adjacent connector housing units; and a protrusion for releasing provisional securing of the first and second connector housing units formed in a fitting plane of the second connector housing, wherein said resilient securing arm is abutted on said provisional securing piece to secure the first connector housing unit to the second connector housing unit provisionally in a state where the first connector housing unit is ahead of the second connector housing unit, wherein after the first connector housing unit is mated with the second connector housing, said protrusion moves said provisional securing piece so that provisional securing of the first and second connector housing units is released, and thereafter the second connector housing unit is mated with the second connector housing.

2. A low-insertion-force connector assembly according to claim 1, further comprising a guiding protrusion formed on the opposite wall of said first connector housing unit; and a guiding groove formed on the opposite wall of said second connector housing unit, wherein said guiding protrusion is engaged into said guiding groove so that the first and second connector housing units are coupled slidably from each other.

3. A low-insertion-force connector assembly according to claim 1, wherein said first connector housing units of the first connector housing is provided with resilient locking pieces for said second connector housing, respectively, and said second connector housing is provided with lock securing holes to be engaged with said resilient locking pieces, respectively.

4. A low-insertion-force connector device according to claim 2, wherein said first connector housing units of the first connector housing is provided with resilient locking pieces for said second connector housing, respectively, and said second connector housing is provided with lock securing holes to be engaged with said resilient locking pieces, respectively.

* * * * *